United States Patent [19]

Meili

[11] 4,163,345

[45] Aug. 7, 1979

[54] ARRANGEMENT FOR THE GRINDING OF ROTARY PROFILE CUTTERS

[75] Inventor: Max Meili, Viganello, Switzerland

[73] Assignee: AG fur Automatisierung, Switzerland

[21] Appl. No.: 807,336

[22] Filed: Jun. 16, 1977

[30] Foreign Application Priority Data

Jun. 17, 1976 [CH] Switzerland ..... 7731/76
Jun. 1, 1977 [CH] Switzerland ..... 6693/77

[51] Int. Cl.[2] ..... B24B 3/02

[52] U.S. Cl. ..... 51/33 W; 51/48 HE; 51/95 LH; 51/225

[58] Field of Search ..... 51/34 A, 34 D, 48 HE, 51/50 R, 50 PC, 50 H, 95 LH, 225, 33 W; 90/11.5

[56] References Cited

U.S. PATENT DOCUMENTS

| | | | |
|---|---|---|---|
| 2,142,710 | 3/1939 | Bigelow | 51/50 R |
| 3,258,880 | 7/1966 | Garin | 51/225 X |
| 3,680,263 | 8/1972 | Johnson | 51/225 X |
| 3,713,254 | 1/1973 | Williams | 51/34 A |
| 3,851,563 | 12/1974 | Habib | 51/48 HE X |

*Primary Examiner*—Nicholas P. Godici
*Attorney, Agent, or Firm*—Robert E. Burns; Emmanuel J. Lobato; Bruce L. Adams

[57] ABSTRACT

An arrangement for the grinding and cutting of rotary profile cutters having, in combination mounted on a base, a first reciprocable table on which is mounted a rotatable platen. A rotatable workpiece carrier assembly is fixed to the platen and these have mutually perpendicular axes of rotation. The carrier holds a collet for the milling cutter blank and a programmable indexer for the angular positioning of the blank in successive position. A second table can reciprocate perpendicular to the first and acts as a support for a block carrying a grinding wheel spindle head. The block is capable of oscillation to either side of a vertical position on an axis parallel to the axis of reciprocation of the second table and the grind wheel spindle head can slide perpendicular to the axis of rotation of the block. A rotatable grinding wheel carried by the spindle head can have its plane of gyration moved to either side of the axis of rotation of the block. Means are provided for effecting movement of the tables as are programmable driving mechanisms for controlling the movements.

4 Claims, 19 Drawing Figures

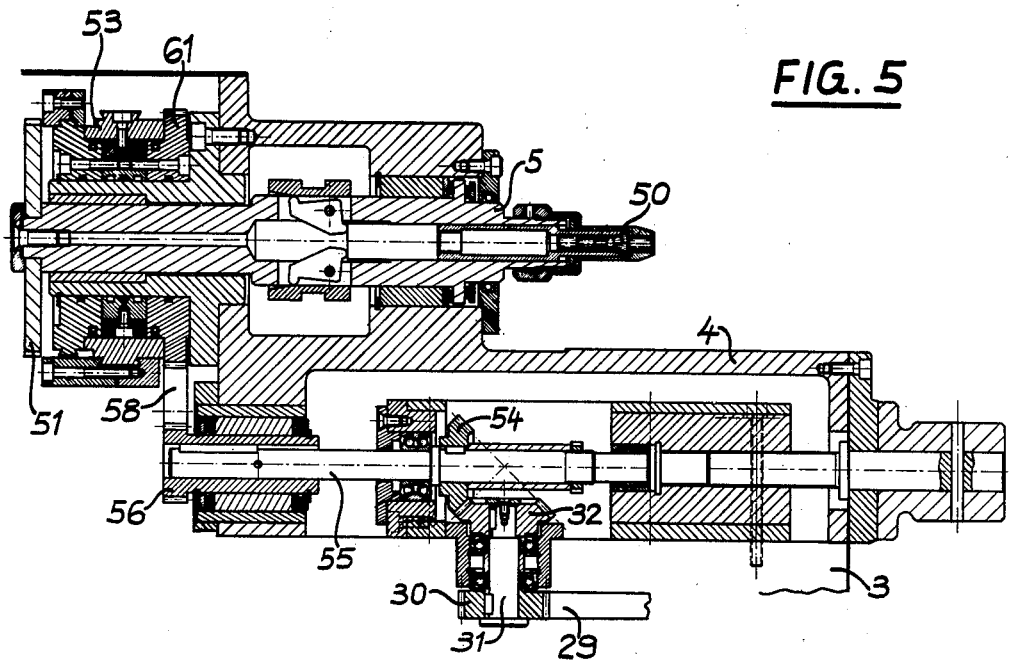
FIG. 5
FIG. 6
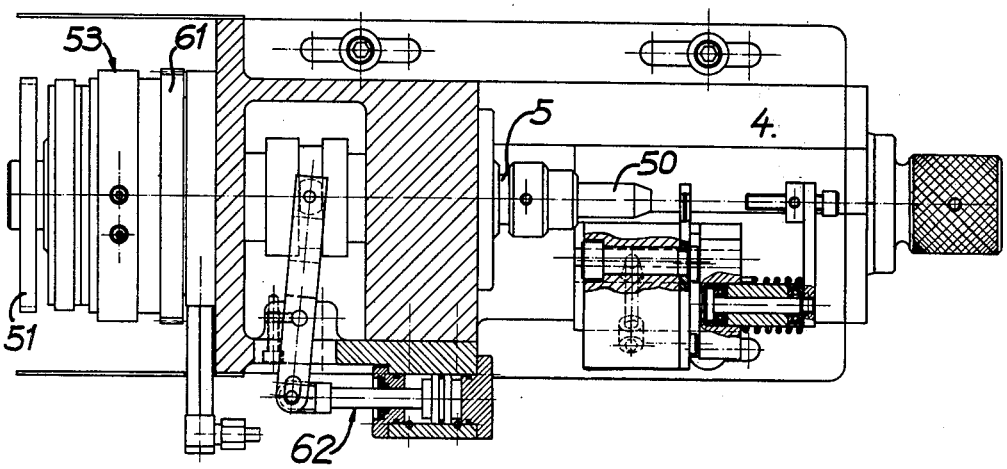

ARRANGEMENT FOR THE GRINDING OF ROTARY PROFILE CUTTERS

BACKGROUND OF THE INVENTION

The subject of the present invention is an arrangement for the grinding and cutting of rotary milling cutters and in particular rotary profile cutters.

At present such cutters, after roughing and profiling, are ground manually on a grinder. This manufacture is very slow, tedious and costly. Generally high-speed or cast steel is used, the use of metal carbides is exceptional in view of the slowness of this hand-cutting process.

SUMMARY OF THE INVENTION

An object of this invention is to make this process automatic.

For this purpose this arrangement is characterized by the fact that it incorporates, in combination, mounted on a base, a first table to which longitudinal linear movements can be imparted and which acts as a support member for a circular platen mounted on this table free to rotate, a workpiece carrier assembly being fixed on the said platen. The axis of rotation of this carrier intersects and is perpendicular to the axis of rotation of the said platen. This carrier holds a collet for the milling cutter blank and a programmable indexer to be used for the angular positioning of the blank in successive preset angular positions; a second table to which lateral linear movements can be imparted perpendicular to those of the first table, this second table acting as a support member for a block carrying, free to slide, a grinding wheel spindlehead. This block is capable of oscillating to either side of a vertical position on an axis of rotation parallel to that of the motion of the second table. The sliding motion of the grinding wheel spindle-head is perpendicular to the axis of rotation of the said block, while the grinding wheel spindle-head is used to carry a rotating grinding wheel whose plane of gyration can be moved to either side of the axis of rotation of the said block. This arrangement also incorporates means for effecting the movement of the tables and the various components they carry, and also programmable driving mechanisms for controlling the said movements.

BRIEF DESCRIPTION OF THE DRAWINGS

The attached drawing shows, as an example, one form of construction which the invention may take.

FIG. 5 is a vertical centre-line section of the workpiece carrier assembly.

FIG. 6 is a plan view with partial sections of the workpiece carrier assembly.

DESCRIPTION OF THE PREFERRED EMBODIMENT

Figure 1:
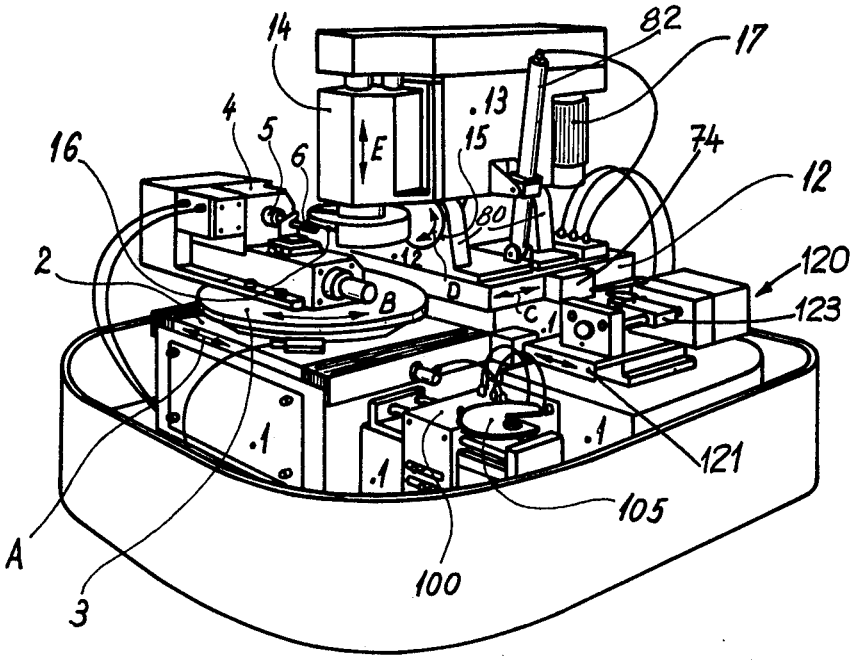
FIG. 1 is a three-quarter perspective view (front) of the equipment.
Figure 2:
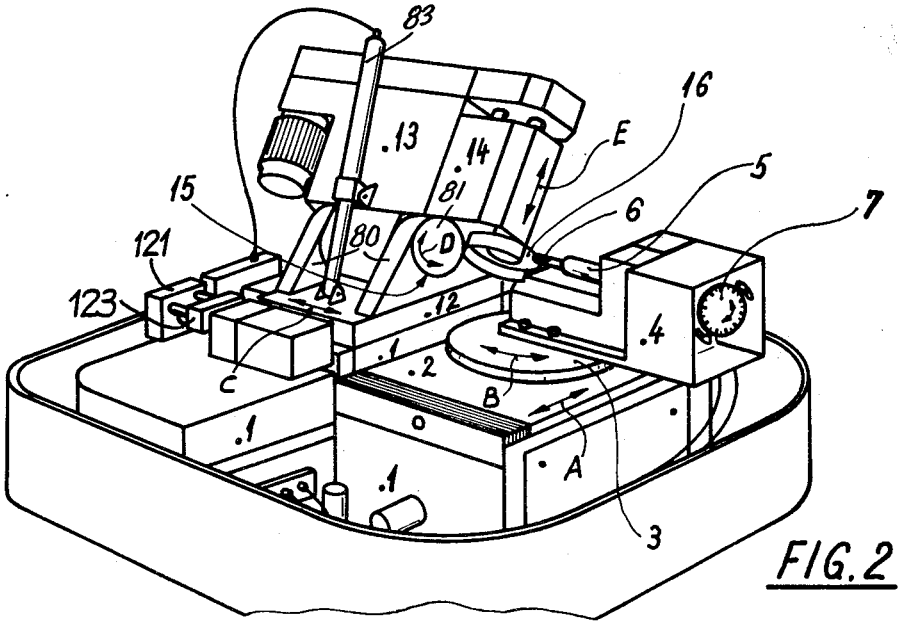
FIG. 2 is a three-quarter perspective view (rear) of the equipment.

The equipment, shown in perspective in FIGS. 1 and 2, incorporates, mounted on a base 1, a first table 2 used to carry a platen 3 mounted free to rotate on this table. A workpiece carrier assembly 4 is fixed on this platen 3. The table 2 can be made to move with a longitudinal linear motion as shown by double arrow A; the platen 3 can be made to move with a rotary motion as shown by double arrow B. The indexer 7 which is programmable enables the workpiece carrier 5, carrying the milling cutter blank 6, to take up various predetermined angular positions.

On the base 1 a second sliding table 12 is mounted, free to move laterally as shown by double arrow C and perpendicularly to the motion of table 2.

On this table 12 a block 13 is mounted free to pivot, carrying a grinding wheel spindle-head 14 free to slide. This block 13 pivots as shown by the double arrow D about a shaft 15 whose axis is parallel to that of the direction of motion of table 12.

The grinding wheel spindle-head 14 slides on the assembly 13 as shown by double arrow E. The sliding motion is carried out perpendicularly to the axis of rotation of the shaft 15. A grinding wheel 16 is driven by a motor 17.

The principal components of this arrangement, thus briefly described, will now be detailed further.

Figure 3:
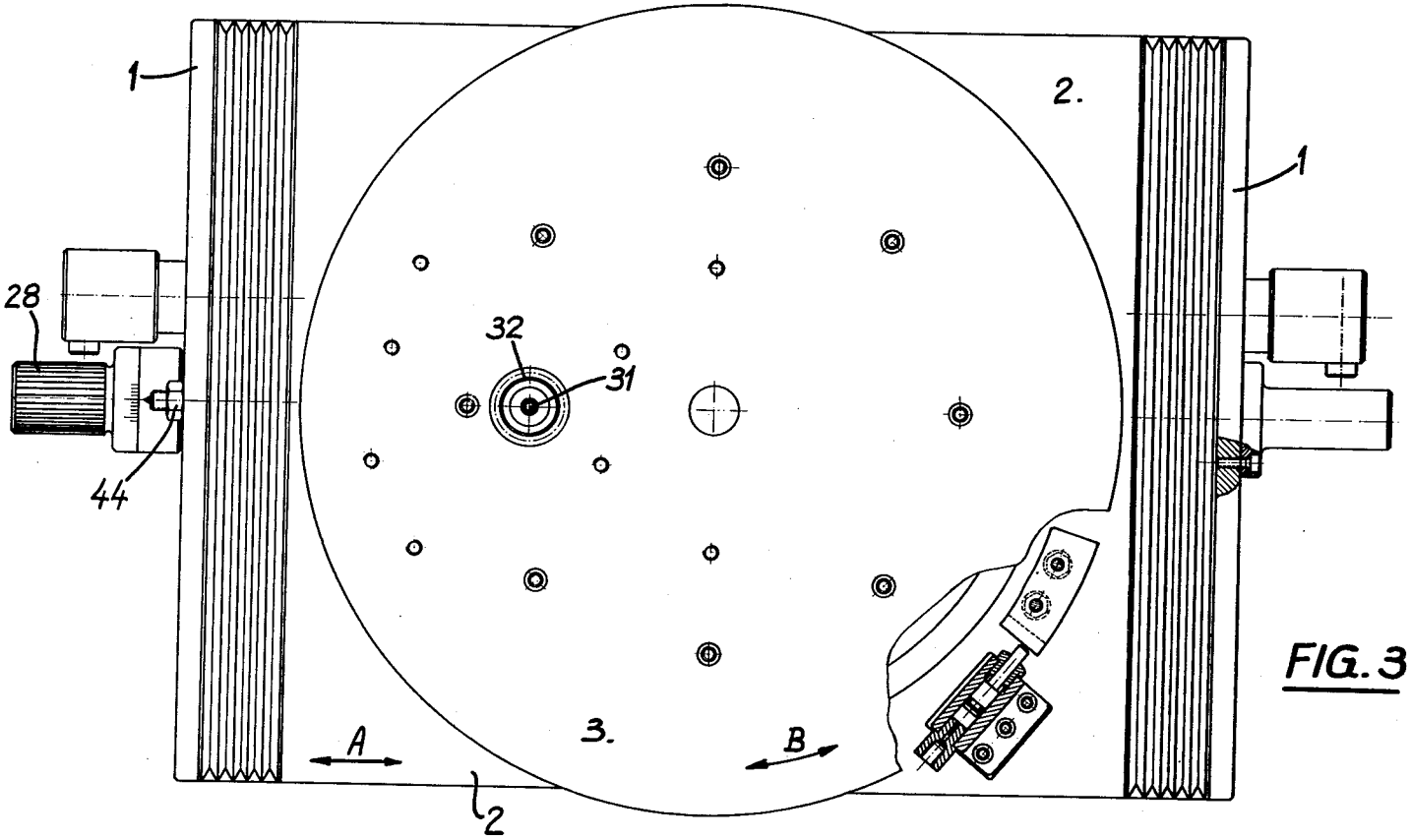
FIG. 3 is a plan-view of the first table and the circular platen.
Figure 4:
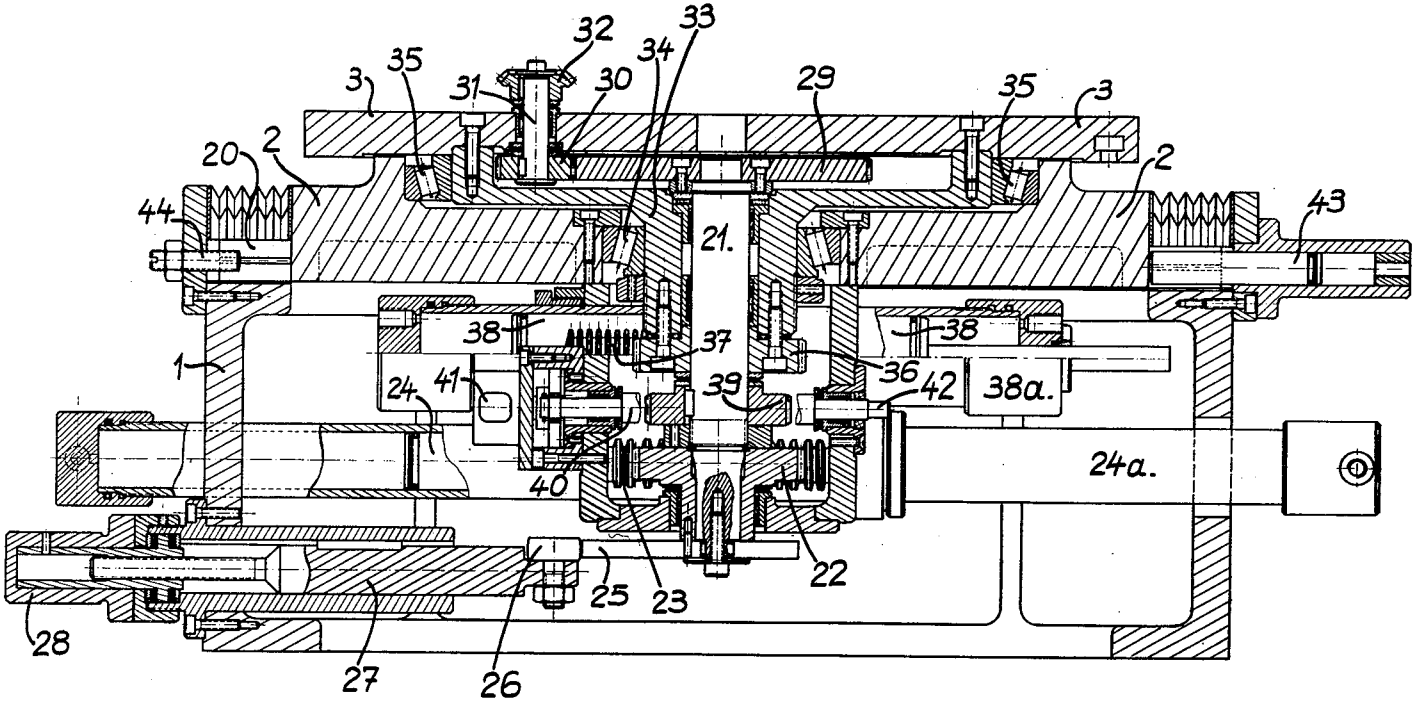
FIG. 4 is a section of the first table and the circular platen.

The first table 2 and the platen 3 are shown in FIGS. 3 and 4.

The first table 2 is mounted free to slide along the base 1 on slides 20. This frame incorporates in its central section a central driving shaft 21 carrying at its lower end a pinion 22 which engages with a rack 23 attached to the hydraulic driving piston 24. On the lower end of the driving shaft 21 an interchangeable master-cam 25 is fixed in contact with the roller 26, itself fixed to the assembly 27 with micrometer adjustment 28.

The driving shaft carries at its upper end a gear-wheel 29 meshing with the pinion 30 fixed to a lower end of the shaft 31 pivoting in the rotary platen 3 and acting as a support to the block 4 of the workpiece carrier 5. This shaft 31 carries at its upper end a bevel gear 32 protruding from the platen 3 and designed to rotate the workpiece carrier 5, as will be described later. The driving shaft 21 is mounted free to rotate on needle bearings in a housing 33 mounted so as to rotate on roller bearings 34, 35, housed within table 2. On the upper part of this rotating housing 33 the platen 3 is fixed, carrying the block 4 of the workpiece carrier 5. On the lower part of this housing 33 a drive wheel 36 is fixed, engaging with a rack 37 fixed to a double-acting piston 38.

The effect of the motion of piston 24 is to rotate the drive shaft 21.

The effect of the motion of piston 38 is to rotate the platen 3 supporting the workpiece carrier assembly.

On the driving shaft 21 a wheel 39 of a 45° bevel gear drive is also fixed, driving a similar wheel fixed on shaft 40. This shaft on the one hand drives a potentiometer 41 and, on the other hand, is in contact, by its extremity 42, with a copying drive which will be described later.

The sliding table 2 is activated by a hydraulic cylinder 43 which maintains the master-cam 25 in contact with the roller 26.

The operation of the table 2 and the platen 3 is as follows:

The cylinder 24*a* receives pressurized oil in the chamber placed to the right of the drawing, the piston 24 travels to the left driving, in rotation, through the rack 23 and pinion 22, the shaft 21. Simultaneously the piston 43 pushes table 2 and hence maintains the master-cam 25 in contact with the roller 26.

The drive shaft 21 rotates; it drives the master-cam 25 and thus table 2 which follows the movements controlled by this cam. This shaft also drives the workpiece carrier fixed to the platen through the wheel 20 and pinions 30, 32.

The master-cam 25 works by gravity, its rotation controls the movements of table 2 from right to left. This movement is curtailed when table 2 comes into contact with the stop 44. When this stopping of table 2 takes place the cam 25, working by gravity, continues to rotate and loses contact with the roller 26.

Figure 7:
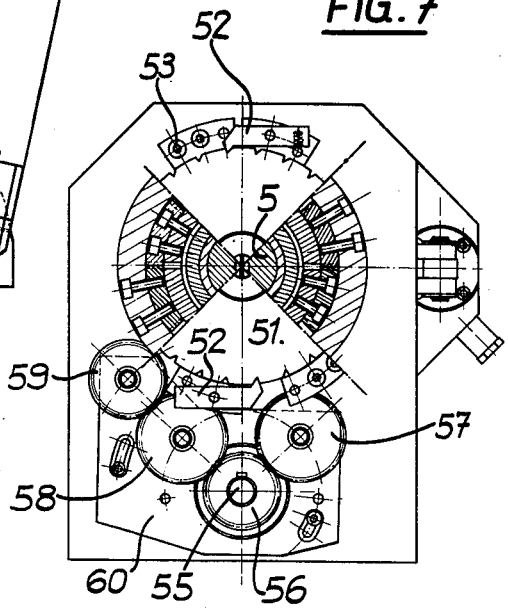
FIG. 7 is a partial view of the indexer of the workpiece carrier.

The assembly 4 of the workpiece carrier 5 is illustrated in FIGS. 5, 6 and 7. This assembly 4 is fixed on the platen 3. This assembly 4 supports the arbor 5 of the carrier. This arbor 5 carries at one of its ends the collet 50 destined to clamp the blank to be machined. The opening and closing of this collet 50 is controlled by a known hydraulic mechanism 62. Fixed to the other end of shaft 5 is the indexing quadrant 51 which is interchangeable and whose division corresponds to a defined number of teeth (segment) of the milling cutter.

This indexing quadrant 51 is driven by a drive system used to rotate, step by step, the carrier arbor for the successive grinding of each segment of the cutter and to rotate, at each step, the said carrier arbor to obtain a helicoidal-shaped machining of this segment and its direction (right or left-hand helix).

The step-by-step rotation of shaft 5 is obtained and controlled hydraulically using pawls 52 mounted on an oscillating assembly 53.

The helicoidal machining rotation is controlled by the drive shaft 21 activated by the piston 24 via the wheel 29, the pinion 30, the bevel gear 32, the bevel gear 54, the shaft 55, the wheel 56 meshing with the two wheels 57, 58, the latter within wheel 59. Wheels 57, 58 and 59 are pivoted on a movable support plate 60 capable of taking up two positions: a first one in which wheel 57 meshes with wheel 61 (right-hand helix) and a second one in which wheel 59 meshes with wheel 61 (left-hand helix). The position of support plate 60 is fixed according to the required helix handing.

Figure 8:
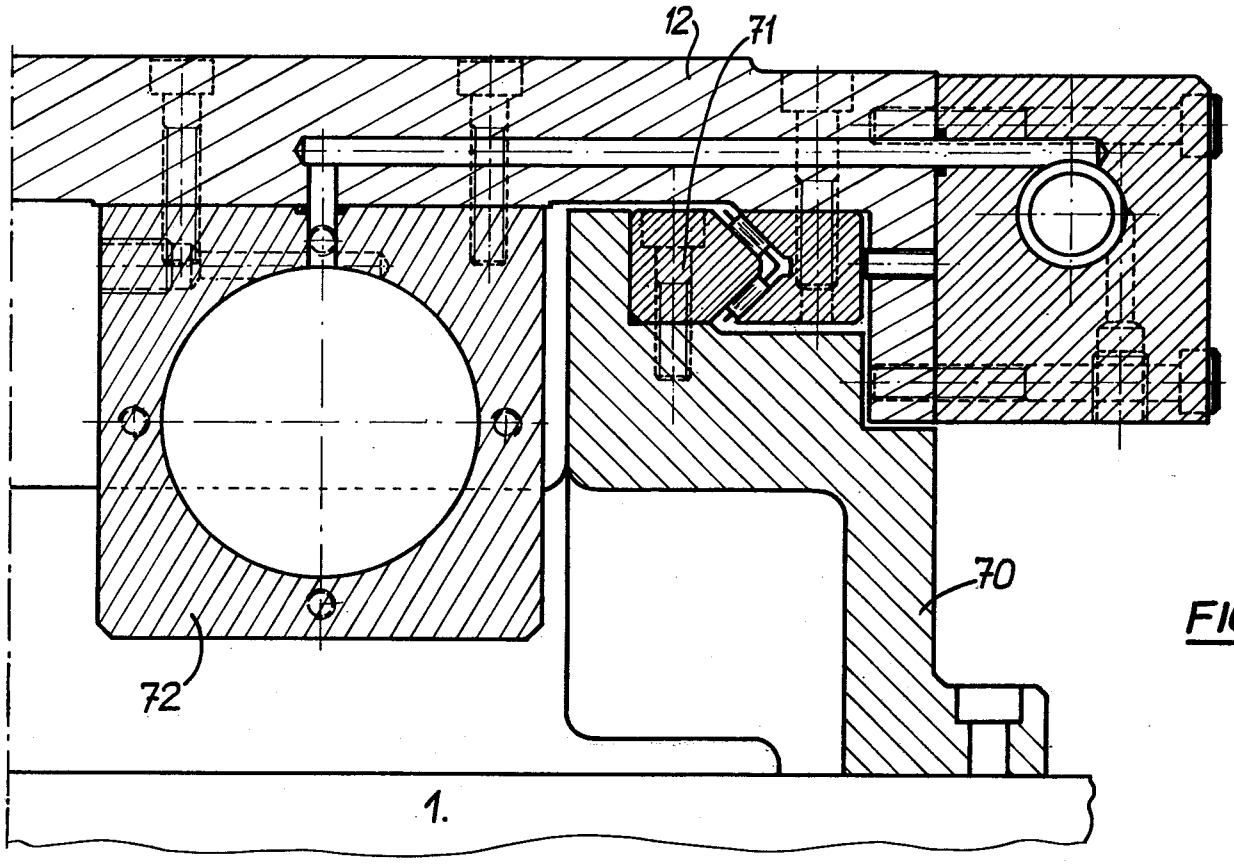
FIG. 8 is a half section of the second table.
Figure 9:
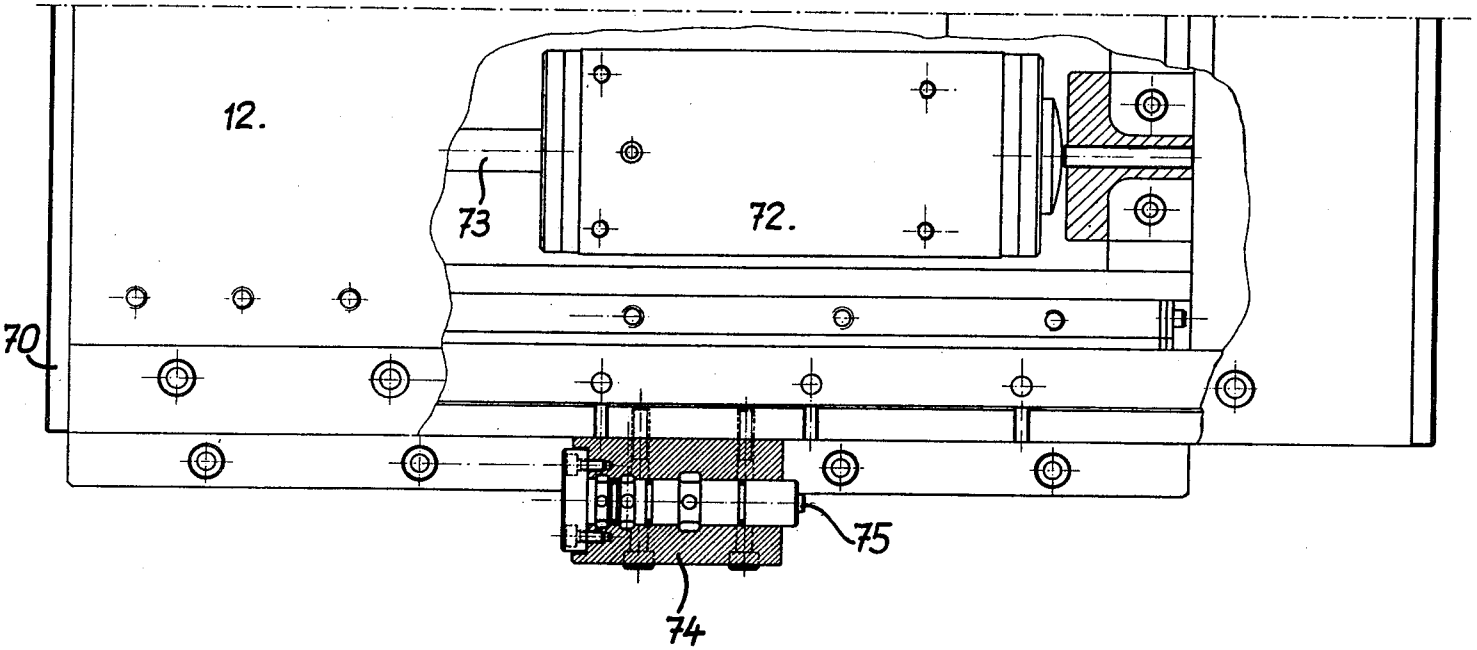
FIG. 9 is a half plan-view with partial cutaway of the second table.

The base 1 carries a second table 12 mounted free to slide on this base (FIGS. 8 and 9) and on which the block 13 is mounted, carrying the grinding wheel spindle-head 14 (FIGS. 1 and 2).

This table consists essentially of slide carriers 70 on which the table 12 comes into motion using slides 71. The displacements of this table 12 are controlled by a hydraulic cylinder 72 fixed to the table 12. A piston 73 is fixed to the slide carrier 70. The cylinder 72 incorporates two chambers of unequal surfaces, the smallest being directly coupled to the high pressure oil source. The larger surface chamber receives the pressurized oil through a valve 74 equipped with a fingerfeeler 75 which opens or closes the oil inlet or allows its escape according to its position. According to the position of the finger 75 the table 12 will move in one direction or the other, or will remain motionless.

Figure 12:
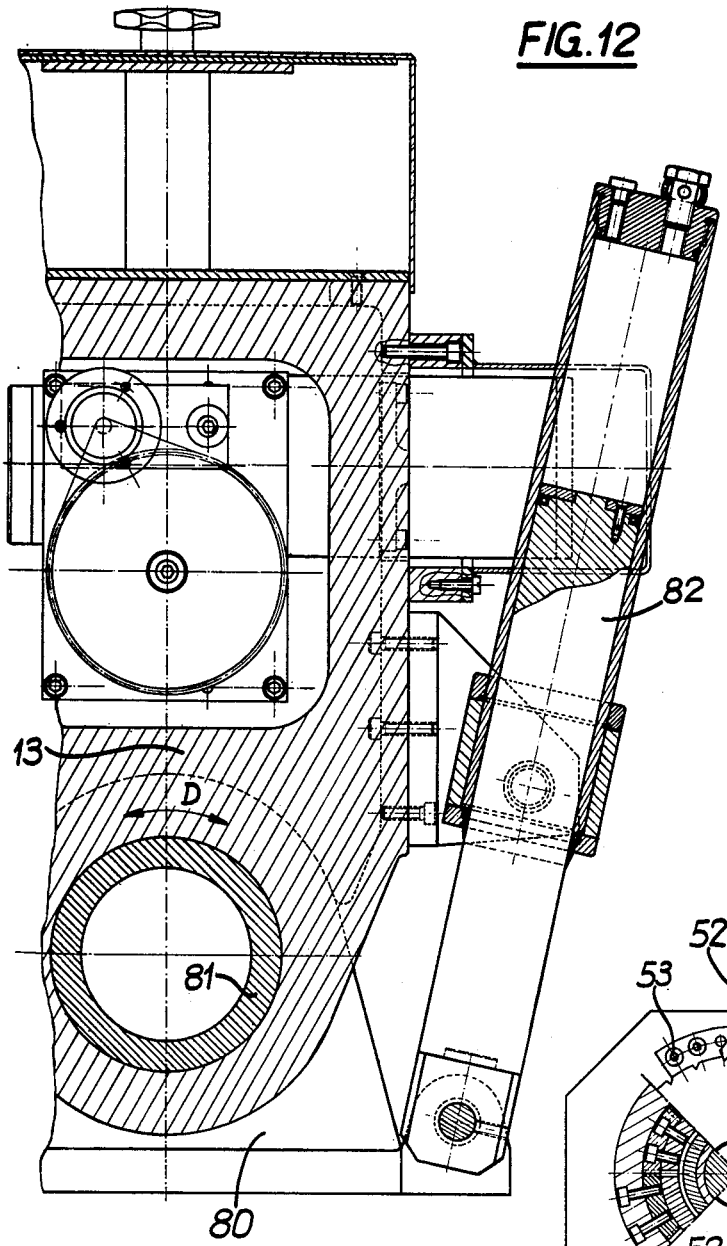
FIG. 12 is a part section showing details of the block shown in FIG. 10.
Figure 10:
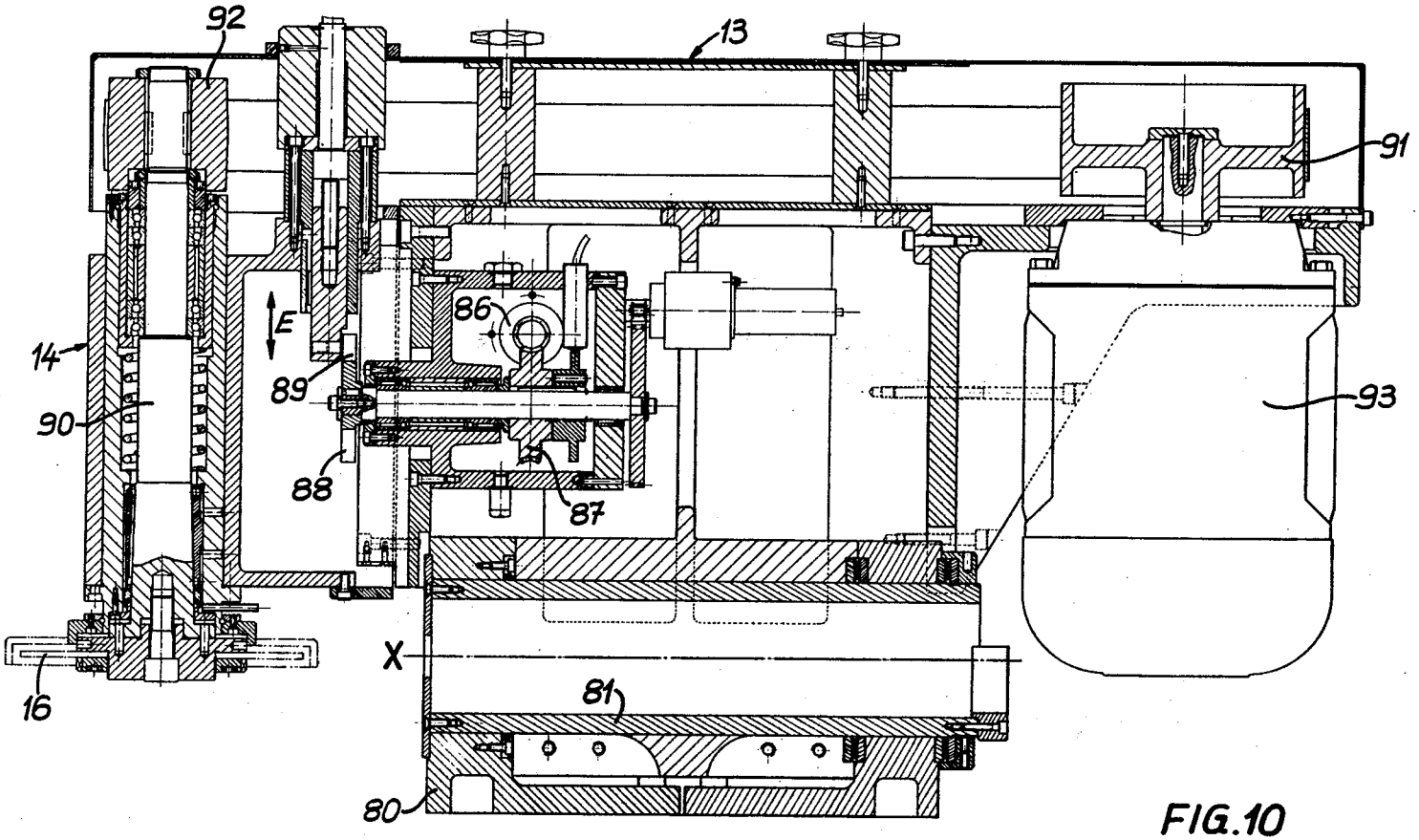
FIG. 10 is a centre-line section of the block carrying the grinding wheel spindle-head.
Figure 11:
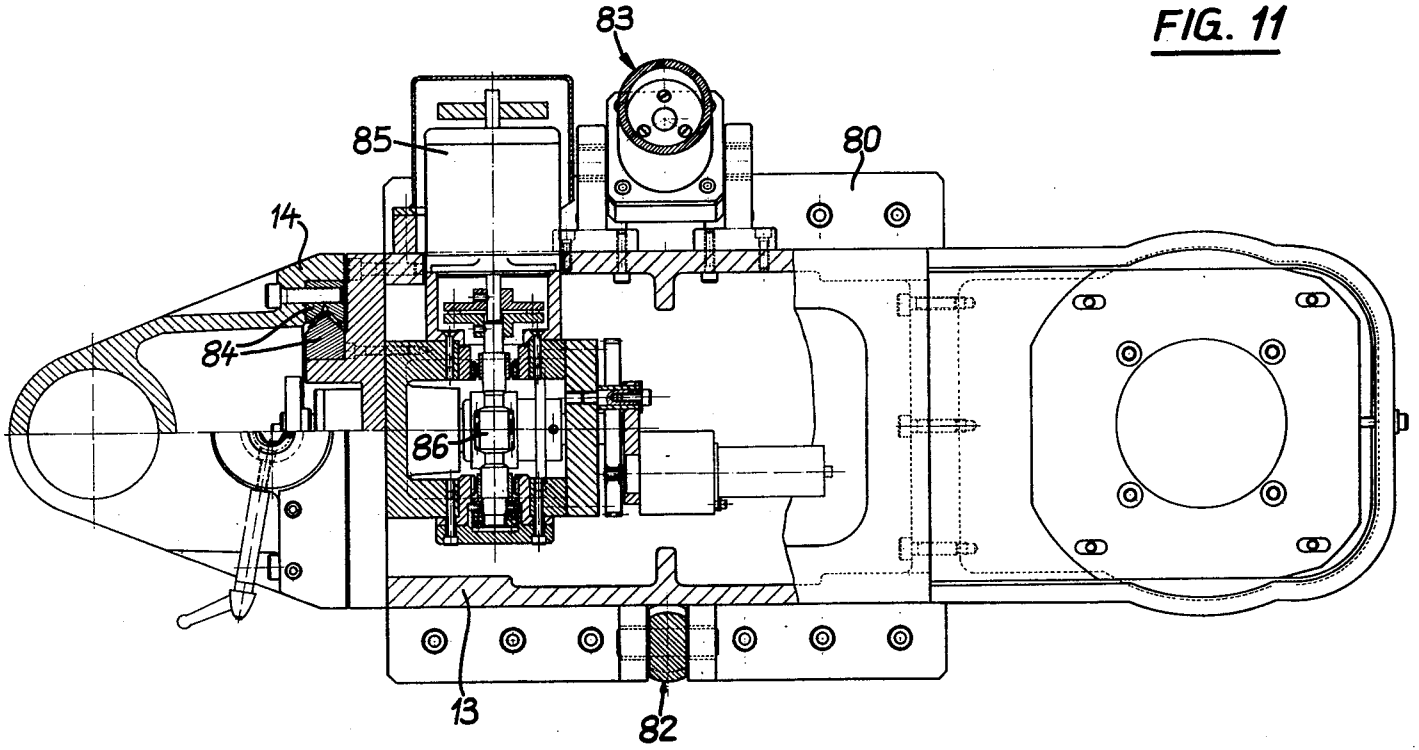
FIG. 11 is a plan view with section and partial cutaway of the block shown in FIG. 10.

The block 13, carrying the grinding wheel head 14, mounted on the sliding table 12 (which has just been described) is shown in FIGS. 10, 11 and 12.

The block 13 is pivotally mounted on the table 12 by being rotatable on an axle 81 which extends between spaced supports 80 that extend up from the table 12. By virtue of this pivotal mounting, the block 13 can tilt on either side of its vertical position as indicated by the arrow D in FIGS. 1, 2 and 12. This pivotal motion of the black 13 is controlled by two hydraulic pistons 82 and 83 (FIGS. 11 and 12).

This block 13 carries a grinding wheel spindle-head 14 free to slide using a slide 84 (FIG. 11) on the block 13. The sliding motion of this head 14, as shown by E, is perpendicular to the axis of rotation X of block 13 on the baseplate 80, which corresponds to the centre-line of the axle 81. The sliding motion of the head 14 is controlled by an inching motor driving the cam-shaft 88 via the worm-screw 86 and gear 87. This cam 88 in conjunction with the roller 89 enables the head 14 to slide as shown by arrow E and thus adjust its height in relation to the blank to be machined. An abrasive grinding wheel 16 is fixed on the spindle 90 of the head. Its gyration plane can thus move from side to side of the axis of rotation X of the block 13 on the baseplate 80.

The spindle 90 of the head is driven by the motor 93 via the pulleys 91 and 92.

Figure 13:
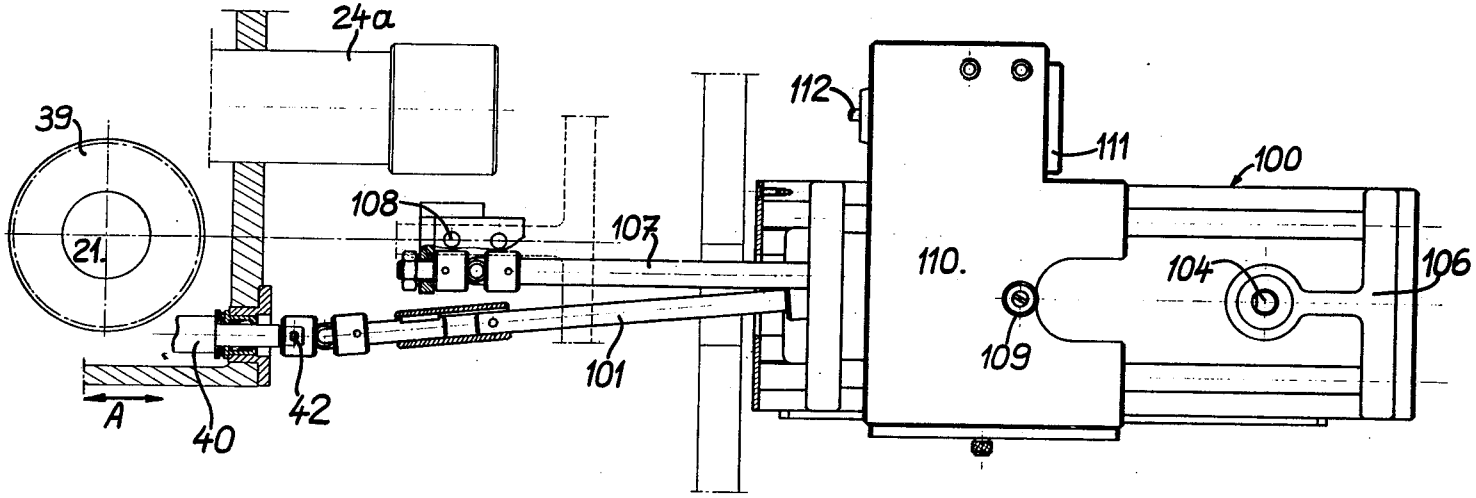
FIG. 13 is a plan view of the copying mechanism of the first table.
Figure 14:
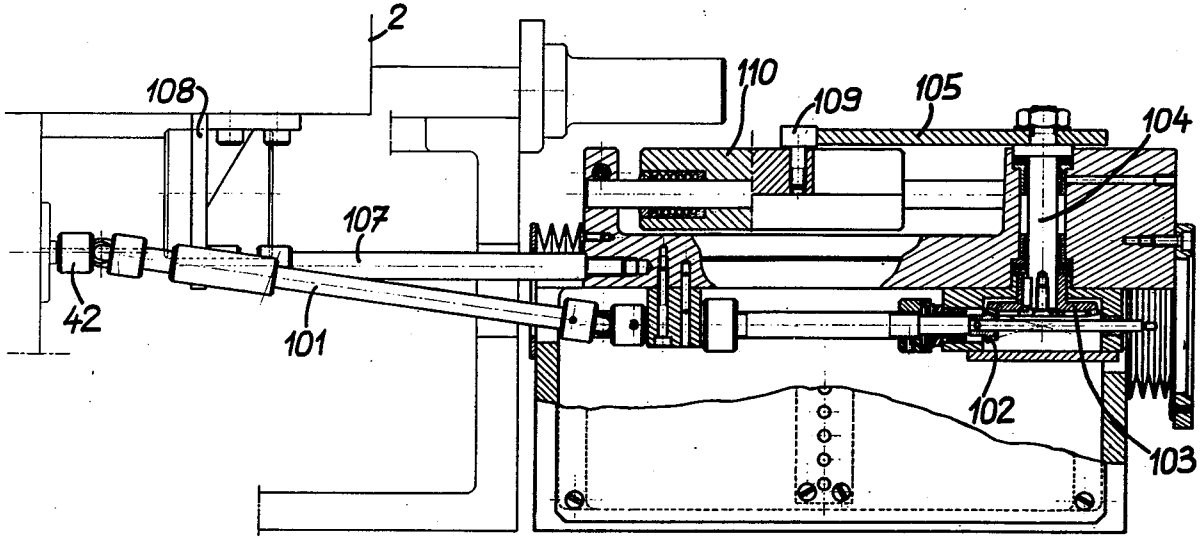
FIG. 14 is a part section and elevation of the mechanism in FIG. 13.

To control the rotation of the platen 3 the equipment includes a copying unit 100 shown in FIGS. 13 and 14. This unit 100 controls this rotation from the shaft 40 of the first table 2 (FIG. 4) which is driven by the driving shaft 21 via the 45° bevel gear 39.

On the shoulder 42 of the shaft 40 a cardan drive 101 is fixed, driving through the right angle gearing 102, 103 the shaft 104 carrying a cam 105. The gear ratio between the drive shaft 21 and the shaft 104 is 1, these two shafts turning at the same speed. Shaft 104 is mounted in a slide 106 which follows the linear movements of table 2 using a connecting rod 107 fixed on the one hand to the slide 106 and on the other hand to a bracket 108 fixed to table 2. On this slide 106 is mounted a second slide 110 whose travel is controlled by the cam 105 acting on the roller 109, pivoted in the slide 110.

This slide carries a copying control valve 111 whose finger feeler 112 is in contact with the extremity of the piston 38 controlling the rotation of platen 3 (FIG. 4).

The operation of this unit is as follows:

The table 2 and slide 106 move together when actuated by the piston 43. The master-cam 25 and the cam 105 revolve at the same speed. If cam 105 moves the second slide 110 is relation to slide 106 by exerting a thrust on the roller 109, the finger 112 of the copying valve is depressed coming to a stop on the end of piston 38. As it is depressed, the finger 112 modifies the aperture of valve 111 feeding the cylinder 38a of the piston 38 whose travel rotates the platen 3. The piston 38 travels until the finger 112 returns to its original equilibrium position.

The profile of cam 105 permits of control of the rotation or immobility of the platen 3 and therefore controls the general profile of the milling cutter to be manufactured:

immobility of the platen corresponds to a cylindrical section, positive rotation of the platen corresponds to a positive slope, negative rotation of the platen corresponds to a negative slope.

To control the forward and backward motion of table 12 carrying the block 13 of the grinding wheel spindlehead, the equipment includes a control unit 120 giving instructions for forward or backward motion to table 12.

Figure 15:
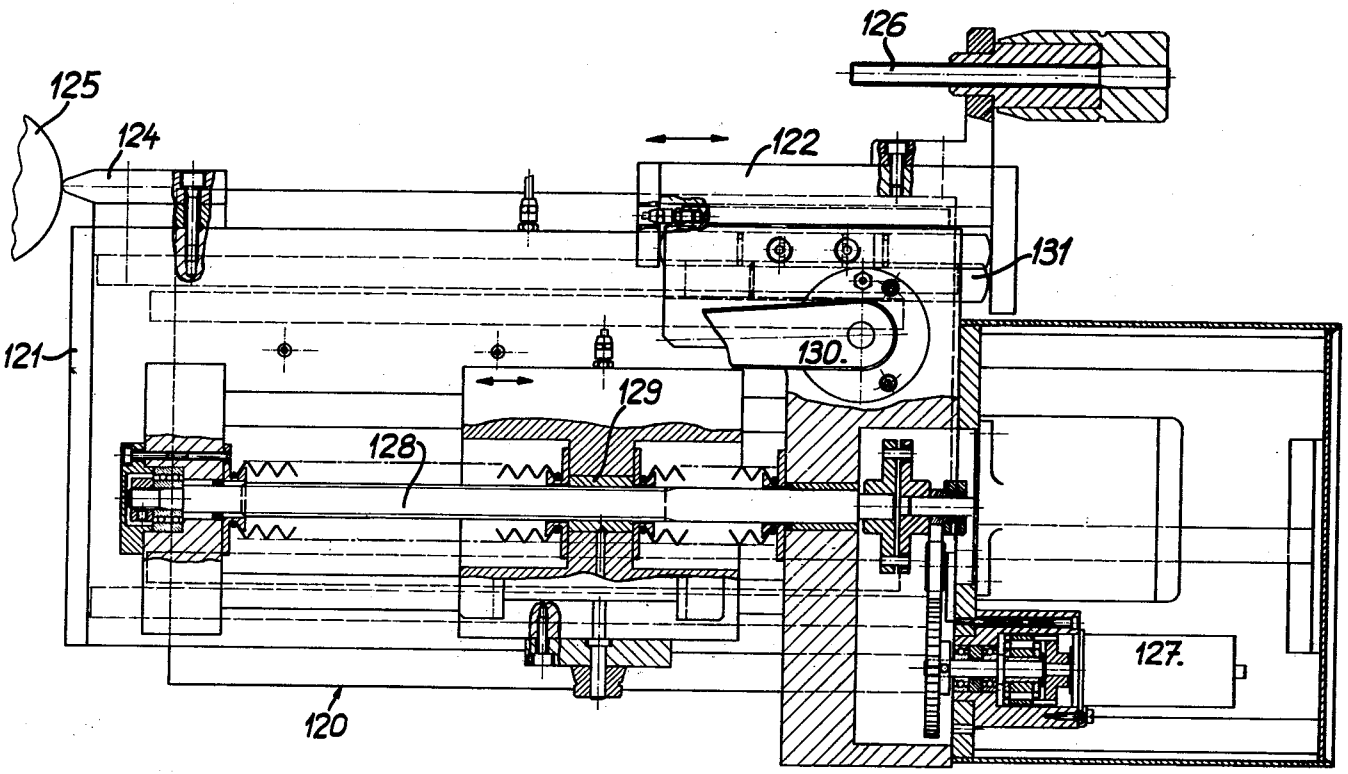
FIG. 15 is a part section of the drive for the block carrying the grinding wheel spindle-head.

This unit, partially represented in FIG. 15, incorporates a first slide 121 which is drawn by means of springs, not shown, towards table 12 carrying the workpiece. This slide can be pushed away from table 12 by operation of a hydraulic cylinder (not shown).

This slide carries a second slide 122 able to move on this first slide, driven by two pistons mounted separately and in opposition in the same cylinder. Slide 122 carries a finger 124 operating in conjunction with a template 125 fixed to table 12.

A third slide 123 can move, also on slide 121, actuated by an inching motor 127 which drives via a belt the screw 128 acting on the threaded bushing 129 fixed to the third slide 123.

The control of forward and backward motion of the grinding wheel is carried out in the following manner:

Feed of the grinding wheel

The cutting off of the feed to the cylinder controlling the slide 121 is effected by the above mentioned springs: the slide 121 is drawn towards the table 12 and the workpiece until the finger 124 comes into contact with the template 125 fixed to table 12. The micrometer screw 126 has encountered the finger-feeler 74 of valve 74 (FIGS. 8 and 9) carried by table 12 and has depressed it causing the feed to the grinding wheel head table 12.

Penetration of the grinding wheel into the workpiece

The slide 122 feeds towards the workpiece, the micrometer screw 126 further depresses the finger 75 of valve 74, ensuring the controlled feed of the table 12.

Withdrawal of the grinding wheel after grinding of a tooth

Slide 122 is withdrawn and the operation of the table 12 is reversed.

To compensate for the depth of the cut, according to the shape of the cutter to be sharpened, the control unit 120 incorporates an amplifying unit consisting of a lever 130 the pivot of which carries a pinion capable of being driven by the rack 131 carried elastically by the second slide 122. When this second slide 122 moves towards the workpiece the rack 131 endeavours to rotate the pinion of lever 130, this rotation is stopped when this lever comes to a stop against a template (not shown) carried by the slide 123. The shape of the template controls the movements of lever 130 and with it the rotation of its pinion and travel of the rack 131. The travel of the latter allows a similar travel of the second slide 122 and starting from the micrometer screw 126, which produces a travel of the grinding wheel slide. It is therefore possible to compensate for the depth of grinding by actuation of the inching motor 127, since this motor makes it possible to modify the position of slide 123 carrying the template against which the lever 130 comes to a stop.

From this description, it may be seen that it is possible to obtain, with three sets of cams (25, 88, 105), a set of indexing quadrants (51) and a set of templates, any conceivable milling cutter profile or tooth structure, the changeover of these sets being speedily carried out.

A variant of the system controlling the rotation of platen 3 in relation to FIGS. 16 and 19 will now be described.

Figure 16:
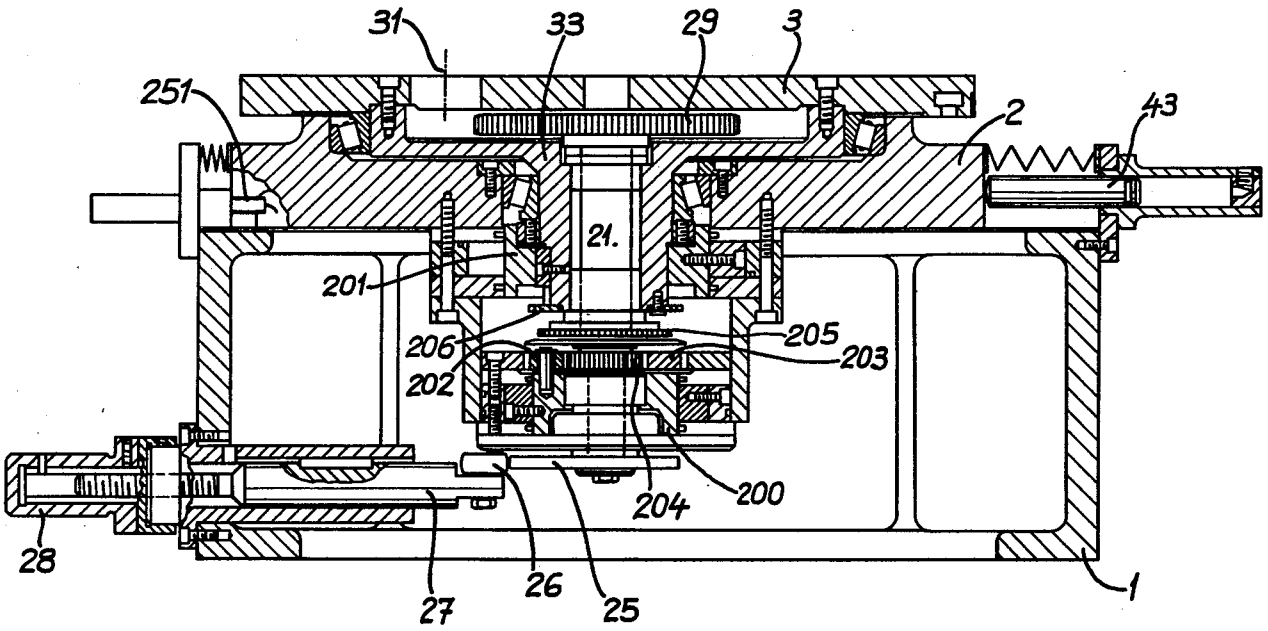
FIG. 16 shows an elevation and section of a constructional variant of the first table and the platen, similar to FIG. 4, but incorporating modifications concerning the drive of the driving shaft 21 and the rotary platen 3.

In FIG. 16 components which have been modified only slightly or not at all in relation to the components in FIG. 4 have the same reference numbers. Pinions 30 and 32 have not been shown. The geometrical axis 31 of these pinions has simply been shown.

Instead of being driven by a rack the drive shaft 21 is driven by a rotary hydraulic piston 200. The same applies to the shaft 33 of the rotary platen 3 which is driven by a rotary hydraulic piston 201. The rotary piston 200 drives the shaft 21 through planetary gears 202 and 203 and a pinion 204 fixed to shaft 21. On the other hand the hydraulic piston 201 directly drives the shaft 33 to which it is fixed. The rotary hydraulic piston 201 is controlled by a programmable device which will be described in relation to FIGS. 17 and 19. With the rotary hydraulic piston solution it is possible to obtain a perfectly uniform rotation without any jerking of the platen 3 and the drive shaft 21.

The drive shaft 21 carries in addition a sprocket 205 to drive a chain. The shaft 33 also carries a chain sprocket 206 whose function will be described below.

Figure 17:
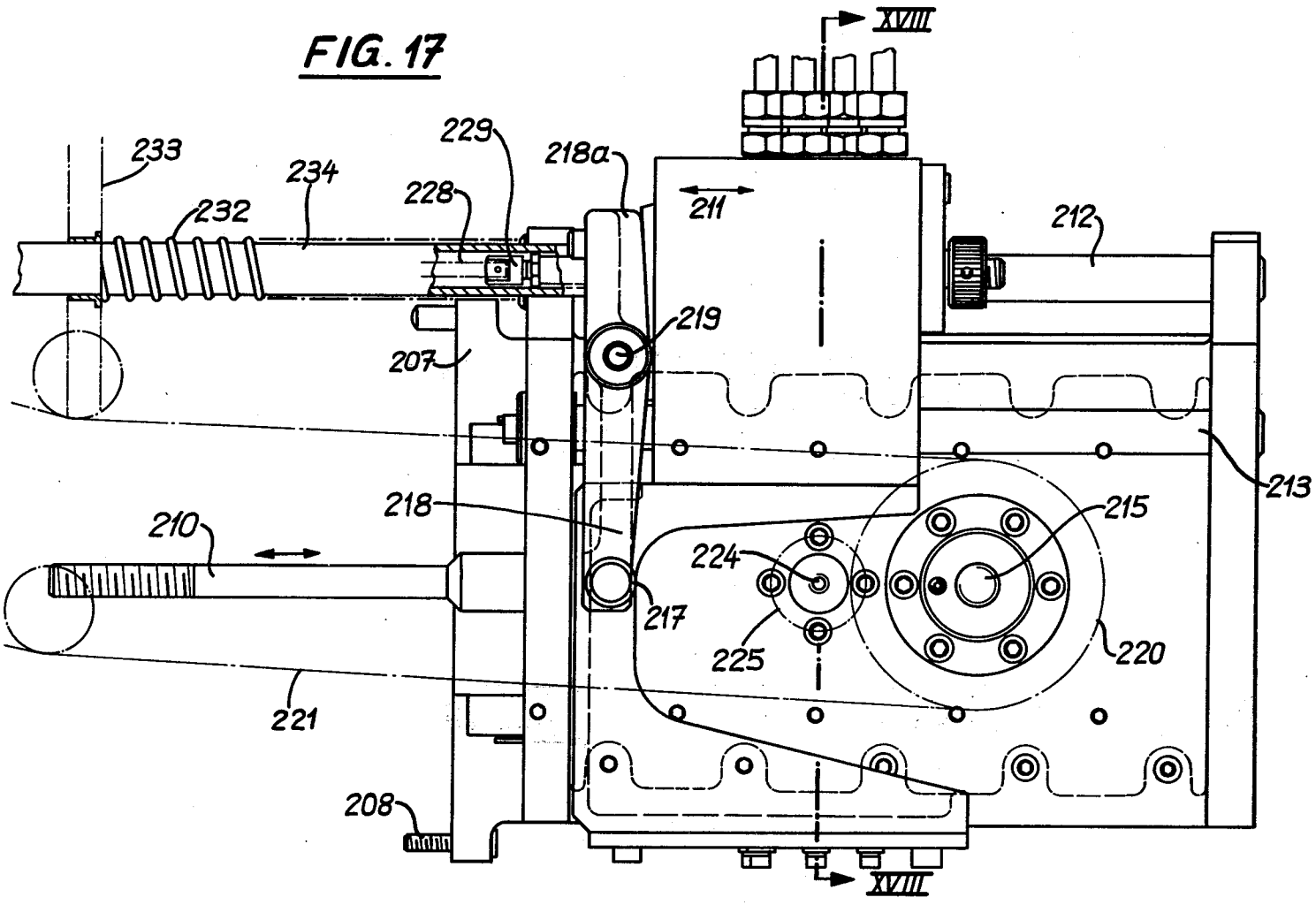
FIG. 17 is a plan view of a constructional variant of the drive system controlling the rotation of platen 3.
Figure 19:
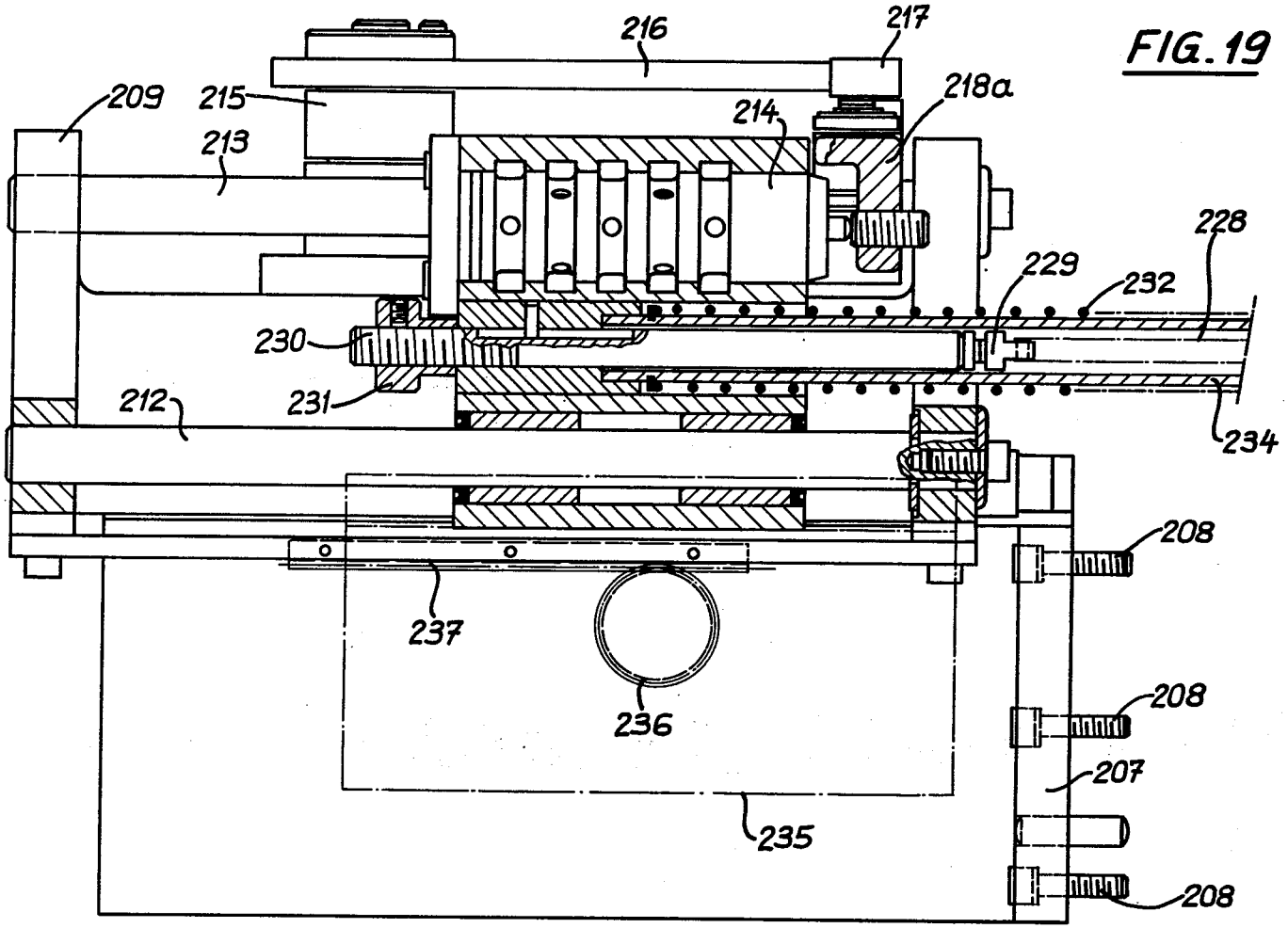
FIG. 19 is a section view through section line XIX—XIX of FIG. 18.

In FIGS. 17 and 19 the control device for the rotation of platen 3 includes a frame 207 fixed to the base 1, to the right of the latter in FIG. 16, level with the chain sprockets 205, 206, by means of screws 208. This frame 207 carries a first slide 209 rigidly attached to slide 2 (FIG. 16) by a tie-rod 210. The slides 2 and 209 are therefore united in travel. The first slide 209 carries a second or copying slide 211, called a copying slide, which slides along two cylindrical guide-bars 212 and 213 fixed to the first slide 209, in the same direction as slide 209. The second slide 211 is attached to a 4-way hydraulic valve 214 (FIG. 19) which controls the motion of the rotary hydraulic piston 201 (FIG. 19) in one direction or the other.

The first slide 209 carries a vertical cam shaft 215 attached to a cam 216 in contact with a roller 217 mounted at the end of a lever 218 pivoted at 219 to the first slide 209 whose other arm 218a acts upon the copying slide 211. The shaft 215 is attached to a chain sprocket 220 connected by a driving chain 221 to the chain sprocket 205 of FIG. 1. Shaft 215 also carries a gearwheel 222 meshing with a pinion 223 mounted on a cam shaft 224 parallel to shaft 215 carrying at its lower end a bevel gear 225 (FIG. 18) driving a bevel gear 226 attached to a horizontal shaft driving a potentiometer 227 producing an analogue electric signal of the angular position of the copying cam 216.

The copying slide 211 is connected to the chain sprocket 206 (FIG. 16) by an open chain 228, with one end fixed to the chain sprocket 206, whereas the other is fixed at a point 229 of a draw-bar 230 threaded on one end and carrying a locknut 231 which comes to a stop against the copying slide 211. The copying slide 211 is held against the locknut 231 by a spring 232 working in compression between this copying slide and a face 233 integral with slide 2 (FIG. 16). The spring 232 surrounds a tube 234 which houses the chain 228. This chain therefore converts the rotary motion of platen 3 to a reciprocating sliding motion of the copying slide 211, so that a displacement of 0,89 mm of the copying slide 211 corresponds to a rotation of 1° of platen 3.

Figure 18:
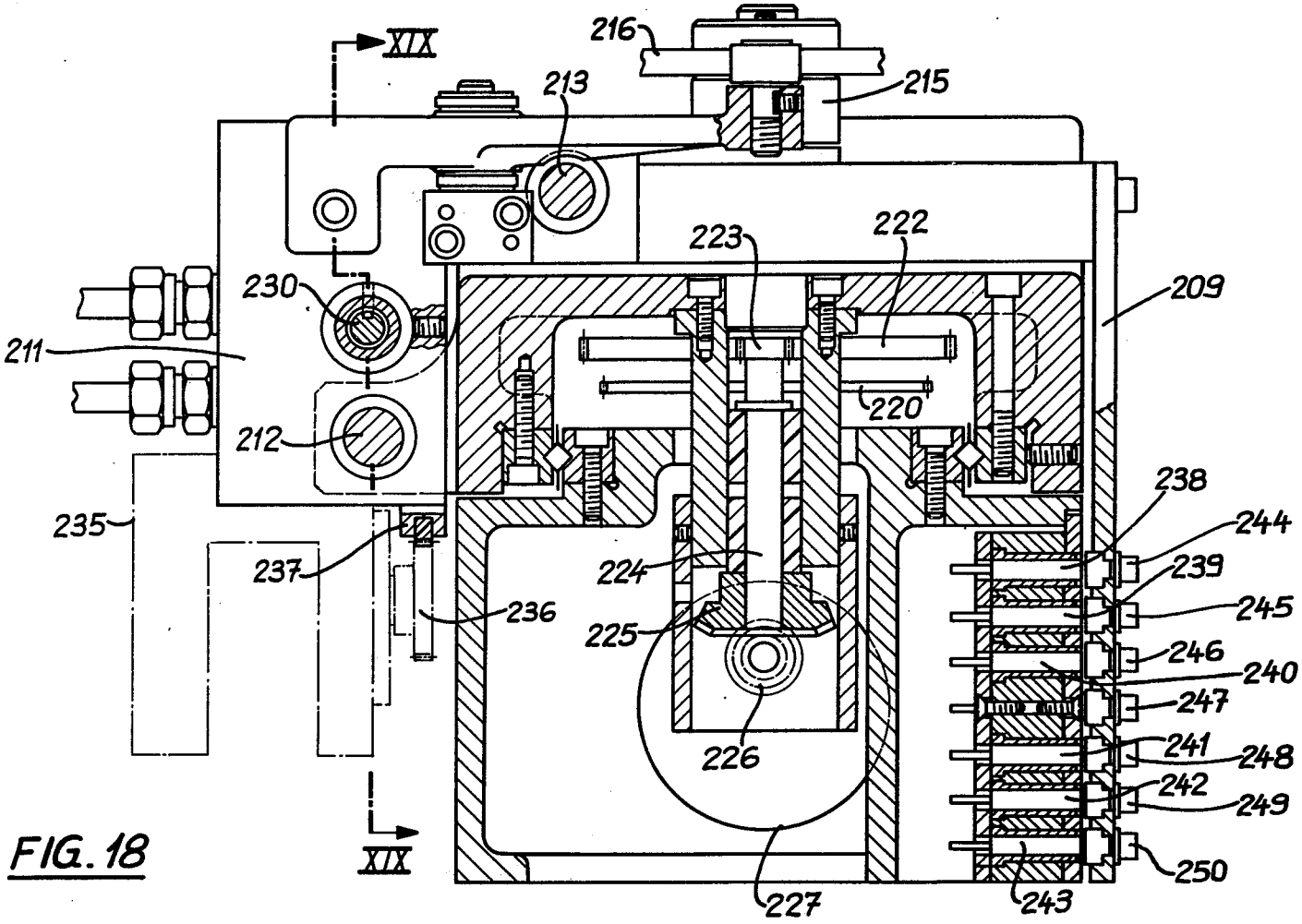
FIG. 18 is an elevation and section through section line XVIII—XVIII on FIG. 17.

The first slide 209 also carries a sump 235 shown by broken lines in FIGS. 18 and 19, a sump carrying a potentiometric unit, not shown, for the conversion of the rotary motion of the drive shaft 21 and master-cam 25 into an analogue electric signal. This potentiometric unit is driven by a pinion 236, itself driven by a rack 237 attached to the copying slide 211.

The frame 207 carries in addition seven magnetic contact proximity detectors 238, 239, 240, 241, 242 and 243 (FIG. 18) lined up vertically and capable of being controlled, in a manner known to the art, by magnetic sensing devices 244 to 250 associated respectively with each proximity detector. These sensing devices can be moved horizontally and individually in slots. They are used to determine the length of the flutes, that is to say the length of the grooves to be ground from one end to the other of the milling cutter in the case of cutters with a rounded tip or with a flame or bulb profile, in which all the cutting edges are not extended to the tip of the cutter. Only some of these cutting edges are extended to the tip, the others finishing at different points before the tip and therefore presenting different lengths. The proximity detectors and their control sensers make it possible to finish the grinding and/or to start it, at different points.

The slide 2 (FIG. 16) also controls at the end of its travel such a proximity detector 251. A microswitch could also be used.

The operation of the device is as follows:

When the rotary piston 200 drives the shaft 21 (FIG. 16), the sprocket 205, through the chain 221, drives the sprocket 220, causing the cam 216 to rotate, which actuates or not, depending upon the profile of its active part, the valve 214, which in turn controls the rotation, or not, in one direction or the other, of the sprocket 206 and consequently the platen 3. Simultaneously the slide 2 and slide 209 move or not, according to the profile of the master-cam 25, and the gearwheel 29 drives the arbor of the workpiece carrier. The cutter to be ground acquires a combined rotary motion around its axis, of longitudinal and rotational displacement around the axis of platen 3, this combined motion corresponding to the profile of the cutter and the profile of the cutting edge, relative to the flute, on the cutter and particularly at the tip of the latter. When the lever 218 is on a cylindrical part of the cam 216 the platen 3 does not rotate, whilst its rotation in one direction or the other depends on whether the cam has a positive or negative slope.

The diagrams of the hydraulic and electric controls are conventional and are not described any further. These controls could be either pneumatic or entirely electrical.

I claim:

1. Apparatus for grinding rotary profile cutters comprising, in combination, a base, a first table mounted on said base for movement linearly thereon, a platen mounted free to rotate on said first table, a rotatable workpiece carrier assembly fixed on said platen, the axis of said workpiece carrier intersecting and being perpendicular to the axis of rotation of said platen, a collet on said workpiece carrier for a milling cutter blank, a programmable indexer on said workpiece carrier for angular positioning of said blank in different successive angular positions, a second table movable linearly perpendicularly to the movement of the first table, a block on said second table, a grinding wheel spindle-head slidable on said block, means mounting said block pivotally on said second table for tilting movement about an axis of rotation parallel to the movements of said second table to opposite sides of a vertical position, the sliding movement of the grinding wheel spindle-head being perpendicular to the axis of rotation of said block when said grinding wheel spindle-head is carrying the rotating grinding wheel, the plane of gyration of said grinding wheel being movable to opposite sides of the axis of rotation of said block, means for effecting pivotal movement of said block about the axis of rotation of said block during the grinding of the milling cutter blank, means for effecting linear movement of said first and second tables, and programmable means for controlling said movements.

2. Apparatus for grinding rotary profile cutters according to claim 1, in which said means for controlling the movement of said second table includes a first slide biased toward the said second table, elastic means biasing said first slide, a second slide of the first slide movable across the first slide, a template attached to the second table, a finger carried on the second slide in contact with said template a third slide on the first slide movable across the first slide, a threaded element free to rotate connected to the third slide, a rotary driven worm-screw cooperatively meshing with said threaded element, and an inching motor for driving the worm-screw.

3. Apparatus for grinding rotary profile cutters according to claim 2, in which said means for controlling said second table includes an amplification unit to compensate for depth of cuts on a cutter, said unit comprising a lever, a pivot for said lever, a pinion, a rack and pinion on said second slide meshing with said pinion, a template attached to said third slide against which said lever comes to a stop, said inching motor varying the position of the third slide and thereby the position of the last-mentioned template.

4. Apparatus for grinding rotary profile cutters according to claim 1, a hydraulic cylinder having a rotary piston, to rotate the platen, means controlling the rotation of the platen including a first slide attached to the first table, a second slide carried on the last-mentioned slide, a multiway control valve attached to said second slide to control the piston, a copying cam kinetically connected during rotation with said workpiece carrier and actuating said control valve, and a flexible connection between said platen converting linear movement of said second slide to rotary motion for rotating said platen.

* * * * *